US007788780B2

(12) United States Patent
King

(10) Patent No.: US 7,788,780 B2
(45) Date of Patent: Sep. 7, 2010

(54) MONITORING SYSTEM FOR FASTENER PLACING TOOL

(75) Inventor: Richard Paul King, Welwyn (GB)

(73) Assignee: Avdel UK Limited (GB)

( * ) Notice: Subject to any disclaimer, the term of this patent is extended or adjusted under 35 U.S.C. 154(b) by 315 days.

(21) Appl. No.: 12/066,331

(22) PCT Filed: Sep. 15, 2006

(86) PCT No.: PCT/GB2006/003419

§ 371 (c)(1),
(2), (4) Date: Mar. 27, 2008

(87) PCT Pub. No.: WO2007/031760

PCT Pub. Date: Mar. 22, 2007

(65) Prior Publication Data

US 2008/0223896 A1 Sep. 18, 2008

(30) Foreign Application Priority Data

Sep. 16, 2005 (GB) ..... 0518909.7

(51) Int. Cl.
*B21J 15/28* (2006.01)

(52) U.S. Cl. ..... 29/243.523; 72/21.1; 72/20.1; 72/391.4; 29/243.525; 29/407.05

(58) Field of Classification Search ..... 29/243.521, 29/243.523, 243.524, 243.525; 72/20.1, 72/21.1, 21.4, 391.2, 391.4
See application file for complete search history.

(56) References Cited

U.S. PATENT DOCUMENTS 5,526,669 A * 6/1996 Gjovik et al. ..... 72/391.2

(Continued)

FOREIGN PATENT DOCUMENTS

EP 0 454 890 A1 11/1991

(Continued)

OTHER PUBLICATIONS

European Combined Search and Examination Report dated Oct. 25, 2005 which issued in connection with corresponding British Application No. GB0518909.7.

(Continued)

*Primary Examiner*—David B Jones
(74) *Attorney, Agent, or Firm*—Clark Hill PLC

(57) ABSTRACT

A fastener placing tool (11) for placing fasteners of the break-stem blind rivet type incorporates a force/stroke monitoring device (22) which comprises an assembly body (24) detachably mounted on the tool between the latter and the anvil (18), a load-cell sensor (33) carried by the assembly body (24) for sensing the force applied by the hydraulic piston (16) to the jaw assembly 17 with respect to the anvil (18), and a non-contact stroke-sensor (35) carried by the assembly body (24) for sensing the position of the jaw assembly (17) relative to the anvil (18). The stroke-sensor (35) operates without physical contact with the jaw assembly (17) or any part of the tool moving therewith. To this end the jaw assembly (17) is connected to the hydraulic piston (16) by means of an adaptor tube (23) which has a conical tapering outer surface. The clearance distance between the sensor (35) and the adjacent part of the conical surface of the adaptor tube 23 varies with the axial position of the adaptor (23) and jaw assembly (17).

11 Claims, 5 Drawing Sheets

U.S. PATENT DOCUMENTS

| | | | | |
|---|---|---|---|---|
| 5,600,878 | A * | 2/1997 | Byrne et al. | 29/243.525 |
| 5,666,710 | A * | 9/1997 | Weber et al. | 29/243.523 |
| 7,313,851 | B2 * | 1/2008 | Wang et al. | 29/243.523 |
| 7,331,205 | B2 * | 2/2008 | Chitty et al. | 72/21.1 |
| 7,343,764 | B2 * | 3/2008 | Solfronk | 72/20.1 |
| 7,346,971 | B2 * | 3/2008 | Chitty | 29/243.523 |
| 7,503,196 | B2 * | 3/2009 | Chitty et al. | 72/21.4 |
| 2005/0217097 | A1 * | 10/2005 | Solfronk | 29/243.521 |
| 2006/0230591 | A1 * | 10/2006 | Chitty et al. | 29/243.523 |
| 2007/0113390 | A1 * | 5/2007 | Chitty | 29/243.523 |
| 2007/0175010 | A1 * | 8/2007 | Wang et al. | 29/243.521 |

FOREIGN PATENT DOCUMENTS

| | | | |
|---|---|---|---|
| EP | 0 738 550 | A2 | 10/1996 |
| EP | 0 738 551 | A2 | 10/1996 |
| WO | 2005/025772 | A1 | 3/2005 |
| WO | WO 2005/025772 | * | 3/2005 |

OTHER PUBLICATIONS

PCT International Search Report and Written Opinion dated Dec. 22, 2006 which issued in connection with corresponding International Application No. PCT/GB2006/003419.

PCT International Preliminary Report on Patentability dated Nov. 5, 2007 which issued in connection with corresponding International Application No. PCT/GB2006/003419.

* cited by examiner

MONITORING SYSTEM FOR FASTENER PLACING TOOL

RELATED/PRIORITY APPLICATION

This application is a National Phase filing regarding International Application No. PCT/GB2006/003419, filed on Sep. 15, 2006. International Application No. PCT/GB2006/003419 relies upon British Application No. 0518909.7, filed on Sep. 16, 2005 for priority.

The invention relates to a monitoring system for a fastener placing tool, and more specifically to a force/stroke monitoring system for a tool for placing breakstem fasteners e.g. breakstem rivets. Briefly, such a fastener comprises a substantially cylindrical deformable metallic shell containing within its bore a mandrel of stronger metal, the mandrel comprising a stem with a radially enlarged head at one end and adjacent one end of the shell, the other end (the tail end) of the mandrel protruding from the other end of the shell. Such fasteners are well known to those persons skilled in the art, and are widely commercially available under the Registered Trade Marks AVEX, MONOBOLT, HEMLOK and AVDELOK.

As is well known, a suitable placing tool comprises a nosepiece for contacting the aforesaid other end of the fastener shell, and mandrel-gripping means for gripping the aforesaid protruding tail end of the mandrel. When a fastener is inserted into a suitable aperture in a workpiece comprising two or more members to be riveted together, the placing tool is offered up to the fastener so that the tail end of the mandrel enters the gripping means and the tool nosepiece contacts the end of the shell. The tool is actuated to withdraw the gripping means with respect to the nosepiece, the gripping means grips the mandrel and applies progressively increasing tension to it with respect to the shell, the reaction force on the shell being supported by the tool nosepiece. This causes the mandrel to be progressively moved with respect to the shell, so that the mandrel head enters the shell and causes the latter to radially expand beyond the remote face of the workpiece, and the tool nosepiece to radially expand the end of the shell with which it is in contact, thus fastening the parts of the workpiece together. Increasing tension eventually causes the mandrel to break at a weakened part (a breakneck) at a suitable predetermined position along its length. The tool is powered by a hydropneumatic system. Such tools and their manner of operation and use are well known to those skilled in the art. One example of such a tool is widely commercially available under the Registered Trade Mark GENESIS.

In practice, it is desirable to ensure that such a tool is performing correctly and optimally. The present invention is intended to provide a system which enables this to be done, by making possible the monitoring of the variation of the force applied by the tool to the fastener progressively as the stroke of the tool (i.e. the movement of the mandrel-gripping means relative to the nosepiece) progresses during the placing of a fastener.

The invention provides, in one of its aspects, a monitoring device as set out in the appended Claim 1. Further preferred features are as set out in Claims 2, 6 and 8.

The invention also provides, in another of its aspects, a fastener placing tool as set out in Claim 3. Further preferred aspects are as set out in Claims 4, 5, 6 and 9.

A specific embodiment of the invention will now be described by way of example and with reference to the accompanying drawings, in which.

Figure 1:
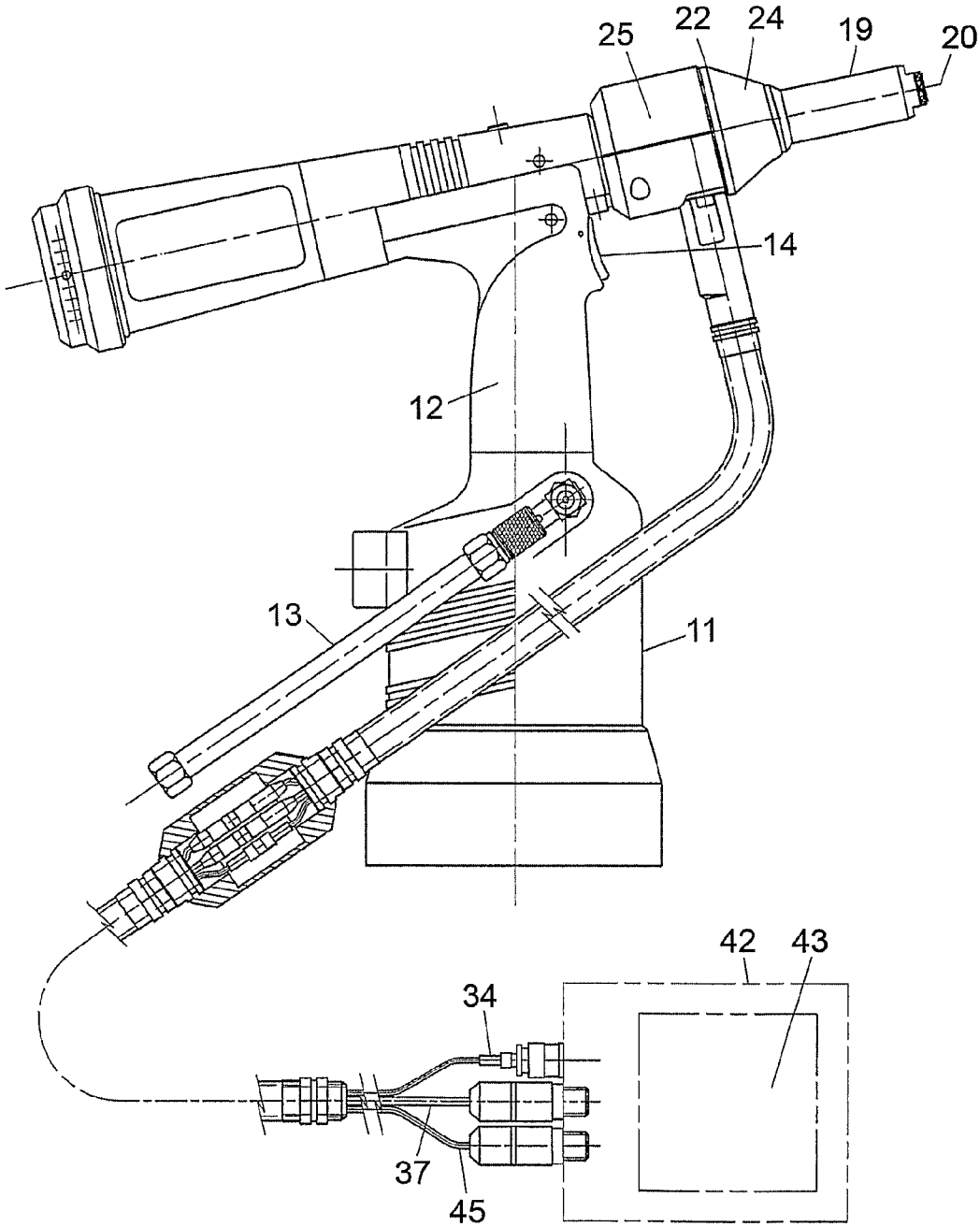
FIG. 1 is an external side elevation of a fastener placing tool incorporating a monitoring device.

The fastener placing tool of this example is commercially available under the designation Genesis model G4HD. Its general form, construction and method of operation and use (apart from the monitoring device) are well known. Briefly, referring to FIG. 1, the tool 11 is hand-held by means of a pistol grip 12 which surrounds the hydraulic cylinder of a pneumatic/hydraulic intensifier, which is fed with air under pressure through a hose 13. Above the pistol grip is a trigger 14, depression of which actuates operation of the tool by opening an air valve 15 (FIGS. 4 and 5) to supply compressed air to the pneumatic/hydraulic intensifier. This causes application of hydraulic fluid under pressure to a hydraulic cylinder containing a hydraulic piston 16, the front end of which is connected to the mandrel-gripping means provided by jaw assembly 17. The piston 16 and jaw assembly 17 move along an axis 20.

The tool includes shell-contacting means for contacting the shell of a fastener to be placed, in the form of an anvil 18 at the forward end of a tubular nosepiece 19, inside which the jaw assembly 17 moves co-axially. In the standard tool without the monitoring device, the rear of the nosepiece is threadedly secured directly to the front end 21 of the tool body, and the jaw-assembly is threadedly secured directly to the front end of the hydraulic piston 16.

Figure 4:
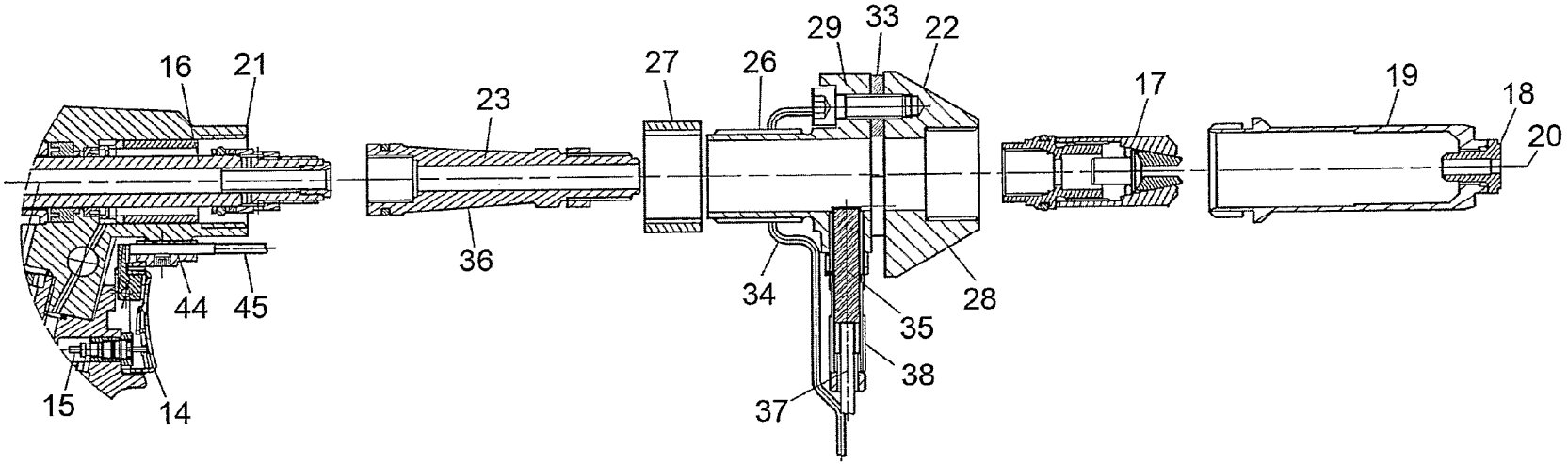
FIG. 4 is an axial section through the monitoring device assembly and the adjacent parts of the tool, illustrating in exploded form how they are assembled together.

In this example, the monitoring device comprises a monitoring assembly 22 which is fitted between the tool body 21 and the nosepiece 19, and a substantially tubular piston adaptor 23 which is fitted between the hydraulic piston 16 and the jaw assembly 17. To fit the device to the tool, firstly the nosepiece 19 and jaw assembly 17 are removed (by unscrewing) from the tool body 21 and the hydraulic piston 16 respectively. Referring to FIG. 4, the piston adaptor 23 is secured at its rear end to the front of the piston 16, and the jaw assembly is secured to the front end of the piston adaptor 23. The monitoring assembly 22 includes a body 24 and a rear cover 25 (not shown in FIG. 4, for clarity of illustration). The body 24 is secured to the front end 21 of the tool body by screwing its rear projecting threaded portion 26 into the front end 21 of the tool body, where it is secured by means of a locknut 27, after the monitoring assembly 22 has been appropriately aligned circumferentially about its axis 20. The relative axial position of the jaw assembly 17 with respect to the nosepiece 18 is the same as it was in the original tool.

Figure 2:
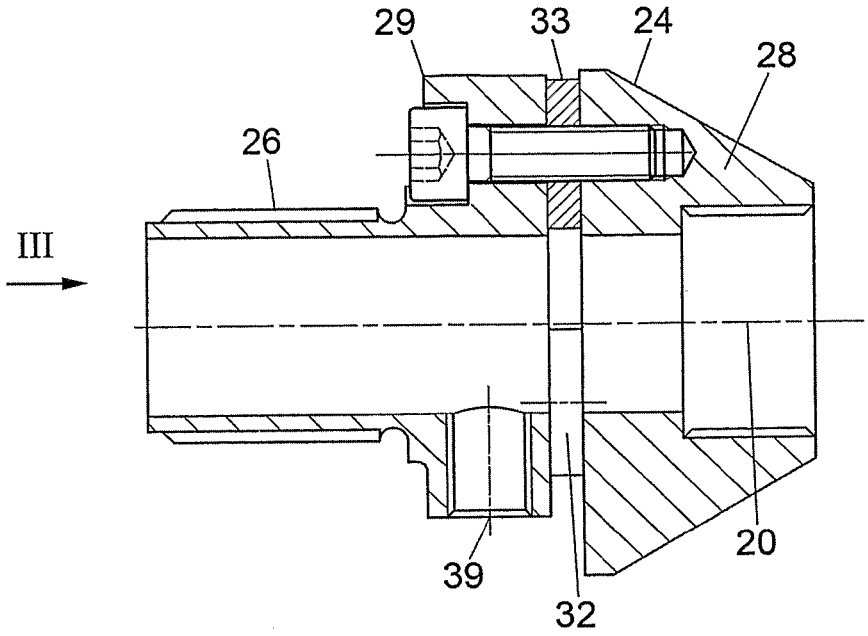
FIG. 2 is an axial section through the body of the monitoring device assembly before it is fitted to the tool.
Figure 3:
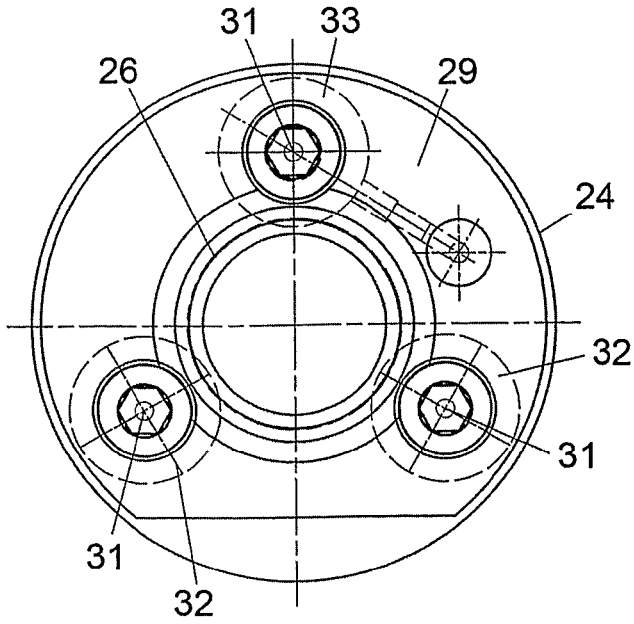
FIG. 3 is an end elevation taken in the direction of the arrow III in FIG. 2, some parts being shown in ghost.

Referring to FIGS. 2 and 3, the monitoring assembly body comprises a front part 28 and a rear part 29 from which latter extends the threaded portion 26. These two parts 28 and 29 are secured together by three screws 31, and spaced apart by two washers 32 (around the two lower screws in FIG. 3) and a load cell sensor 33 around the third screw 31. This senses the compressive force between the two parts 28 and 29 of the body 24, and hence the compressive load between the tool nosepiece 19 and the tool body 21. When the tool is in use placing a fastener, this compressive load is derived from the tension applied to the fastener by the nose assembly 17. Thus, in use of the tool, the load cell sensor 33 senses the force applied to the fastener by the tool. The output signal from the load cell 33 is fed along a cable 34.

Figure 5:
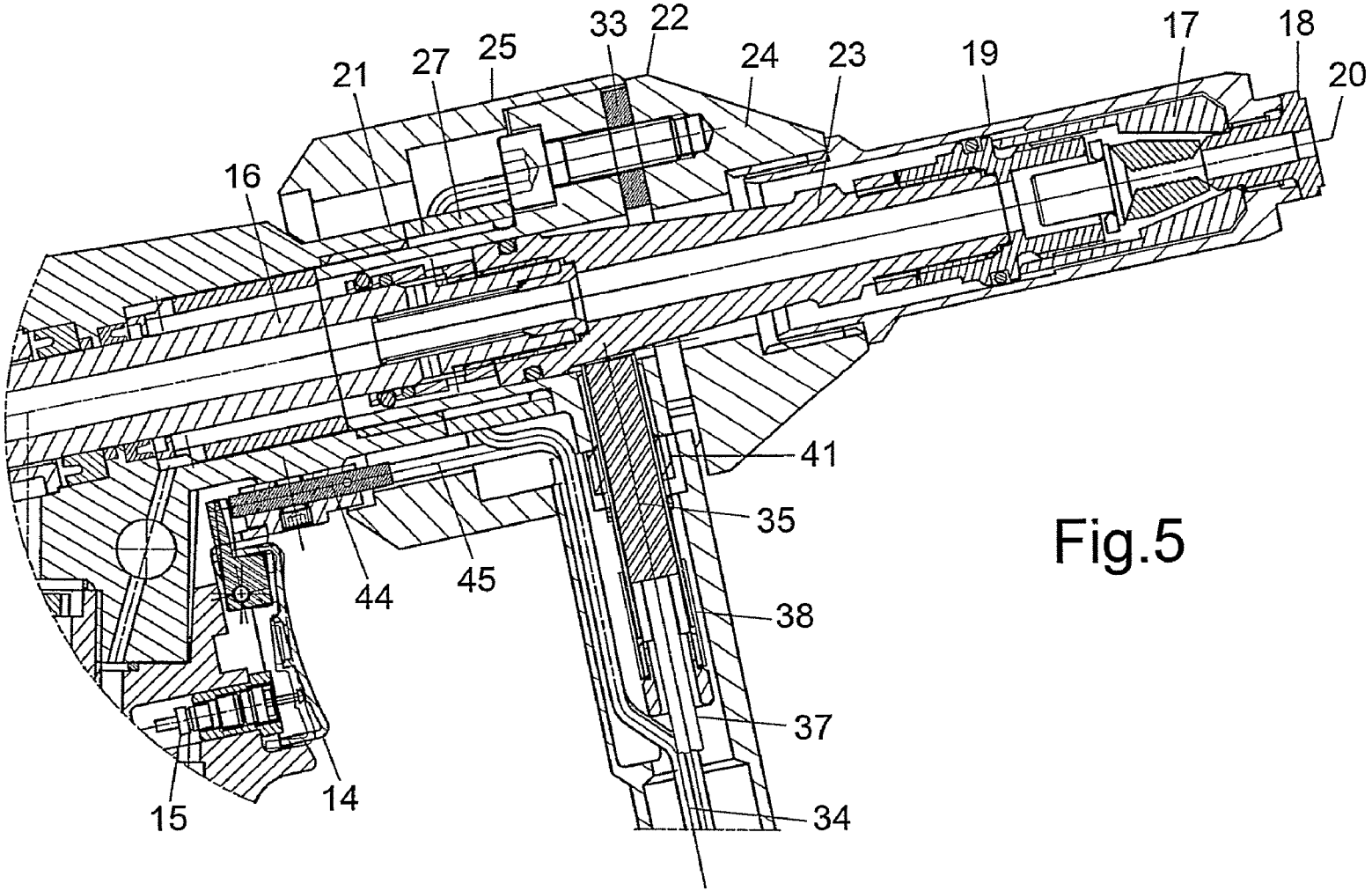
FIG. 5 is a similar axial section through the assembled arrangement.

The sensor assembly body 24 also carries the non-contact stroke sensor in the form of an analogue inductive position sensor 35. As illustrated in FIGS. 4 and 5, the piston adaptor 23 has part of its external surface tapered, and more specifically in the shape of a cone 36 which is co-axial about the axis 20. This extends so that, in use of the tool, the conical surface 36 passes adjacent the stroke sensor 35. The stroke sensor 35 senses the distance between the end of the stroke sensor and the adjacent part of the conical surface 36, which distance will vary linearly with respect to the distance by which the adaptor 23 has been retracted. Since the surface 36 is conical about the axis 20, the rotational position of the adaptor about the axis makes no difference to this radial distance, thereby rendering assembly of the adaptor onto the tool easier. The output of the stroke sensor 35 is conveyed along a cable 37. The sensor body 35 is secured within a sleeve 38 which is threadedly engaged in a threaded bore 39 (FIG. 2) in the rear body part 29, and its position is secured by means of a locking ring 41.

Before the fitting of the monitoring assembly 22 to the tool as hereinbefore described, the stroke sensor is retracted so that it will be clear of the conical tapered surface 36 of the adaptor 23. After fitting together the parts as described above, with the jaw assembly 17 and adaptor 23 in their normal (unactivated) forwards position, the position of the stroke sensor 35 is adjusted until it senses a spacing of 0.5 millimeters from the conical surface 36, and is then locked in that position by the locking ring 41. In use of the tool, as the jaw assembly 17 moves backwards during the placing of a fastener, the spacing sensed by the sensor 35 increases linearly in relation to the distance moved by the jaw assembly.

Figure 6:
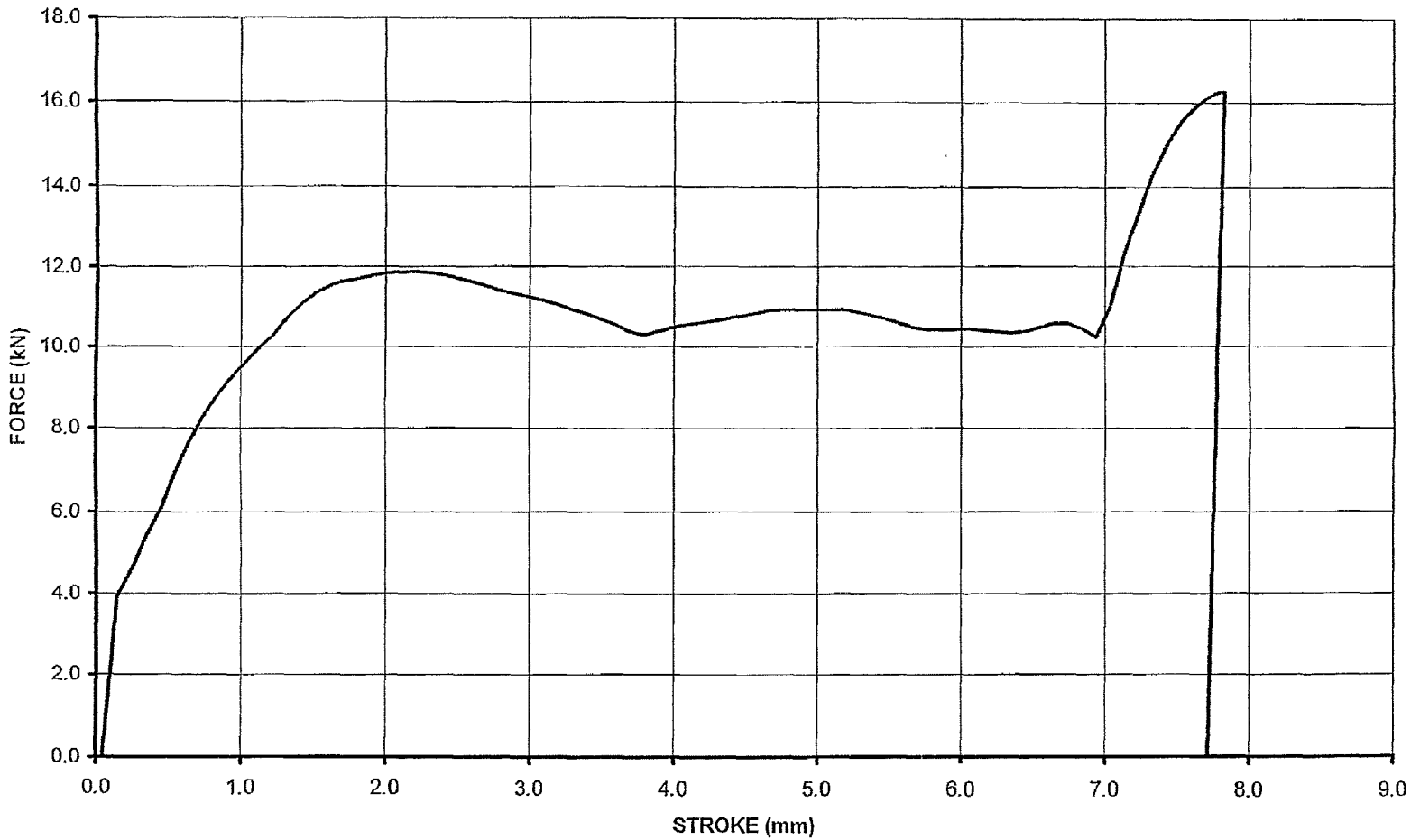
FIG. 6 is an illustrative example of a graphical plot of force against stroke.

The outputs of the force sensor 33 and the stroke sensor 35 are fed along cables 34 and 37 to a monitoring device 42, illustrated schematically in FIG. 1. This interprets the output signals from the force and stroke sensors, and provides resulting inputs to a display device such as a visual display screen 43. This provides a visual display of the force and stroke values as they progress during the operation of the tool 11 to place a fastener, in the form of a graphical plot of stroke value against force value, which visual display is maintained until the start of the next operation of the tool. An example of such a graphical plot is illustrated in FIG. 6. The stroke distance in millimeters is shown along the horizontal axis and the force in kiloNewtons is shown along the vertical axis. The shape of the graphical plot will depend upon a number of factors, such as the design, size and material of fastener being placed by the tool, and the any variation in the progress of operation of the tool due to such things as wear in its moving parts. Observation of the graphical plot can indicate, for example, whether a fastener has in fact been placed by the operation of the tool, and if so, how well the tool is performing.

The signal processing equipment within the monitoring device 42 needs some form of starting and stopping signals to actuate and terminate its processing cycle for each use of the tool to place a further fastener. It may be preferable to use the operation of the tool trigger 14 for this purpose. In this example, the tool is provided with a trigger operation sensor 44 (FIGS. 4 and 5). This is adjustable, and is arranged so that it gives an output only when the trigger has been depressed enough to start operation of the tool. The trigger sensor out put is fed along a cable 45 to the monitoring unit 42, to actuate its operation as aforesaid. The trigger sensor switch 44, like the stroke and force sensors, is readily attachable to, and detachable from, the standard tool.

The invention is not restricted to the details of the foregoing example.

The invention claimed is:

1. A monitoring device for use with a fastener placing tool for placing fasteners of the type comprising a shell and a mandrel to which progressively increasing relative force is applied to progressively move the relative positions of the mandrel and shell thereby to deform the shell, which tool comprises a tool trigger mechanism, shell-contacting means for contacting the shell, mandrel-gripping means for gripping the mandrel, and force-applying means for applying a progressively increasing force to the mandrel-gripping means with respect to the shell-contacting means, thereby to progressively move the mandrel with respect to the shell, the force applying means comprising a hydraulic piston;

which monitoring device comprises;

an assembly body attachable to the tool between the force-applying means and the shell-contacting means;

a force-sensor carried by the assembly body for sensing the force applied by the force-applying means to the mandrel-gripping means with respect to the shell-supporting means;

and a non-contact stroke-sensor carried by the assembly body for sensing the position of the mandrel-gripping means relative to the shell-contacting means, the stroke-sensor operating without physical contact with the mandrel-gripping means or any part of the tool or assembly moving therewith, wherein the device includes an adapter to be sensed by said non-contact stroke sensor and positioned between the mandrel-gripping means and the hydraulic piston to move with the mandrel-gripping means and the hydraulic piston.

2. A monitoring device as claimed in claim 1, which device includes an adaptor which is attachable to the mandrel-gripping means to move therewith, the adaptor including a tapering or inclined lace which moves past the stroke-sensor so that the distance between the stroke-sensor and the adjacent part of the tapering or inclined face varies as the mandrel-gripping means moves and is sensed by the stroke-sensor.

3. A monitoring device as claimed in claim 2, combined with a force/stroke comparison device which is fed with information by the force-sensor and the stroke-sensor and produces a graphical plot of the variation of the stroke with the variation of the force.

4. A fastener placing tool for placing fasteners of the type comprising a shell and a mandrel to which progressively increasing relative force is applied to progressively move the relative positions of the mandrel and shell thereby to deform the shell, which tool comprises shell-contacting means for contacting the shell, mandrel-gripping means for gripping the mandrel, and force-applying means for applying a progressively increasing force to the mandrel-gripping means with respect to the shell-contacting means, thereby to progressively move the mandrel with respect to the shell the force applying means comprising a hydraulic piston;

the fastener placing tool incorporating a monitoring device which comprises:

an assembly body detachably mounted on the tool between the force-applying means and the shell-contacting means;

a force-sensor carried by the assembly body for sensing the force applied by the force-applying means to the mandrel-gripping means with respect to the shell-supporting means;

and a non-contact stroke-sensor carried by the assembly body for sensing the position of the mandrel-gripping means relative to the shell-contacting means, the stroke-sensor operating without physical contact with the mandrel-gripping means or any part of the tool or assembly moving therewith, wherein the monitoring device includes an adapter to be sensed by said non-contact stroke sensor and positioned between the mandrel-gripping means and the hydraulic piston to move with the mandrel-gripping means and the hydraulic piston.

5. A tool as claimed in claim 4, which tool includes an adaptor which is attached to the mandrel-gripping means to move therewith, the adaptor including a tapering or inclined face which moves past the stroke-sensor so that the distance between the stroke-sensor and the adjacent part of the tapering or inclined face varies as the mandrel-gripping means moves and is sensed by the stroke-sensor.

6. A tool as claimed in claim 5, in which the tapering or inclined face of the adaptor is conical in shape.

7. A fastener placing tool as claimed in claim 5, combined with a force/stroke comparison device which is fed with information by the force-sensor and the stroke-sensor and produces a graphical plot of the variation of the stroke with the variation of the force.

8. A fastener placing tool as claimed in claim 6, combined with a force/stroke comparison device which is fed with information by the force-sensor and the stroke-sensor and produces a graphical plot of the variation of the stroke with the variation of the force.

9. A monitoring device as claimed in claim 1, combined with a force/stroke comparison device which is fed with information by the force-sensor and the stroke-sensor and produces a graphical plot of the variation of the stroke with the variation of the force.

10. A tool as claimed in claim 9, in which the tool trigger mechanism is provided with a trigger operation sensor, which also feeds information to the force/stroke comparison device, thereby to actuate the comparison device when the trigger is operated to actuate the force-applying means.

11. A fastener placing tool as claimed in claim 4, combined with a force/stroke comparison device which is fed with information by the force-sensor and the stroke-sensor and produces a graphical plot of the variation of the stroke with the variation of the force.

* * * * *